United States Patent [19]

Licht et al.

[11] Patent Number: 4,657,563

[45] Date of Patent: Apr. 14, 1987

[54] RESIN BONDED GRINDING WHEELS WITH FILLERS

[75] Inventors: Robert H. Licht, Hudson; Robert L. Holden, Auburn, both of Mass.

[73] Assignee: Norton Company, Worcester, Mass.

[21] Appl. No.: 793,440

[22] Filed: Oct. 31, 1985

[51] Int. Cl.[4] ..... B24D 3/00

[52] U.S. Cl. ..... 51/308; 51/298; 51/307; 51/309

[58] Field of Search ..... 51/298, 308, 309, 307

[56] References Cited

U.S. PATENT DOCUMENTS

| | | | |
|---|---|---|---|
| 1,830,757 | 11/1931 | Hartmann | 51/308 |
| 2,022,893 | 12/1935 | Martin | 51/299 |
| 2,110,630 | 3/1938 | Martin | 51/307 |
| 2,216,135 | 10/1940 | Rainier | 51/298 |
| 2,249,278 | 7/1941 | Kistler | 51/298 |
| 2,811,430 | 10/1957 | Gregor et al. | 51/307 |
| 2,949,351 | 8/1960 | Vigliatura | 51/298 |
| 2,952,529 | 9/1960 | Stone | 51/298 |
| 3,469,959 | 9/1969 | Stein | 51/308 |
| 3,934,988 | 1/1976 | Barfield | 51/308 |

FOREIGN PATENT DOCUMENTS

| | | |
|---|---|---|
| 56-102478 | 8/1981 | Japan . |
| 0444141 | 3/1936 | United Kingdom . |

OTHER PUBLICATIONS

Resinoid Wheel Fillers, N. P. Robie, Grinding and Finishing, Dec. 1961.

*Primary Examiner*—Paul Lieberman
*Assistant Examiner*—Willie J. Thompson
*Attorney, Agent, or Firm*—Arthur A. Loiselle, Jr.

[57] ABSTRACT

An improved resin bonded grinding wheel composition is shown making use of a kyanite or sillimanite or andalusite filler or mixtures thereof. More particularly the grinding wheel is a hot pressed phenol formaldehyde wheel having an alumina-zirconia abrasive with a kyanite additive therein. These wheels can be used for heavy duty metal grinding and have been determined to be especially useful for the snag grinding of titanium metal.

9 Claims, No Drawings

RESIN BONDED GRINDING WHEELS WITH FILLERS

TECHNICAL FIELD

This invention relates to resin bonded grinding wheels and more particularly to hot pressed heavy duty snagging wheels.

BACKGROUND AND INFORMATION DISCLOSURE STATEMENT

The following publication is representative of the most relevant prior art known to the Applicants at the time of filing of the application.

Resinoid Wheel Fillers, N. P. Robie,

Grinding and Finishing, December 1961.

Metal billets are prepared for rolling mill operations by having their surface imperfections such as shrinkage cracks, crevices resulting from the casting operations and oxidized areas ground away. This preliminary grinding process is performed on manually manipulated or manually controlled power driven machines adapted to produce very high pressure and high surface speed at the grinding face of the wheel so that these snagging wheels must be made to be very rugged and durable. Special heavy duty abrasives have been developed for snagging grinding and likewise special resin bonds have been found to be especially durable for use in making snagging wheels.

The most useful of the conventional snagging wheels known to date are made with cofused alumina-zirconia abrasive grains distributed throughout a phenol-formaldehyde bond mixture polymerized under very high pressure and the necessary temperature conditions. Such wheels are used for snagging metal billets and it has been found that certain additives may be included in the raw batch mix from which the wheels are made, which additives are present during the grinding operations and make the grinding operation more efficient.

Various kinds of these grinding aids have been suggested for use in snagging wheel compositions for grinding of all types of metal products. A comprehensive discussion of conventional grinding wheel fillers and their function in enhancing the grinding operation of various forms of vitrified and resin bonded grinding wheels for various kinds of grinding operations, is set forth in the article "Resinoid Wheel Fillers" by N. P. Robie published in the December 1961 issue of Grinding and Finishing. On page 45 of this publication, a list of U.S. patents is set forth and the particular filler or grinding aid covered respectively in the listed patents, is named.

While the grinding aids disclosed herein have been found to be particularly useful for grinding titanium billets, these fillers will serve also for the grinding of other metals.

Typical hot pressed, resin bonded snagging wheels available today for grinding titanium billets include a mixes as indicated by compositions A and B in the following:

TABLE I

| Ingredient | Vol. % Standard Bonds | |
|---|---|---|
| | Composition A | Composition B |
| Alumina-Zirconia Abrasive, 6–16 mesh | 57.60 | 57.60 |
| Phenol-formaldehyde resin | 23.81 | 21.89 |
| Powdered Silicon Carbide | 9.22 | 5.76 |

TABLE I-continued

| Ingredient | Vol. % Standard Bonds | |
|---|---|---|
| | Composition A | Composition B |
| filler (−325 mesh) | | |
| Powdered Cryolite, $Na_3AlF_6$ | — | 6.53 |
| Polyvinylidene Chloride | 2.30 | 1.15 |
| Powdered Quick Lime (CaO) | 3.07 | 3.07 |
| Chopped Fiberglass | 4.00 | 4.00 |

Wheels as described above are used for snagging iron, steel and other commercial metals when processed to form hard durable hot pressed grinding wheels. The Mix B has been found to be more useful for grinding titanium which is a difficult metal to grind for the reason that it has a high affinity for oxygen and oxidation occurs during the grinding process to produce heat that adds to the heat generated by the frictional grinding operation itself. Since the titanium metal has a relatively low thermal conductivity as compared to ferrous alloys for example, this mechanically and chemically caused build up of heat is objectionable because it accelerates wear of the abrasive grains and damages the resin bond of the wheel. Also the grinding of titanium causes problems because of the shearing characteristics of this metal which necessitates a greater expenditure of energy at the grinding interface while producing thinner chips as compared with ferrous type metals. Thus higher unit grinding forces must be produced between the snagging wheel and a titanium billet as compared with the snagging of iron and steel billets. Thus, the difficulty of grinding titanium as compared with snagging ferrous metals may be characterized by the problems resulting from somewhat higher temperatures, titanium's extreme chemical reactivity, and the high unit pressures that must be exerted to effect its grinding. These problems cause poor wheel life, a low grinding ratio and result in higher costs for the snagging of titanium as compared with the snagging of ferrous billets.

The present invention provides a grinding wheel composition particularly adapted for the grinding of titanium billets but which also has advantages when used for the grinding of other metals. The use of the novel grinding aid means described below renders the snagging wheels here described more resistant to the deleterious effects of temperature and pressure and provides a lower cost additive as compared with those used in the best snagging wheels known today.

DISCLOSURE OF THIS INVENTION

In its broadest concept, it has been found that the use of kyanite or other alumino-silicates as a filler in a resin bond grinding wheel composition, together with the typical combination of polyvinylidene chloride, quick lime and chopped fiberglass, makes possible the production of a snagging wheel having general utility but which is particularly adapted for the snagging of titanium billets. The composition can be additionally improved with the addition of powdered cryolite.

EXAMPLES OF THE PREFERRED EMBODIMENTS

Wheels having the following proportions intimately mixed together and hot pressed to produce hard dense snagging wheels, are typical of our invention:

TABLE II

| Compositions Included in Invention Vol. % in Wheel | | | | |
|---|---|---|---|---|
| Ingredient | Comp. C | Comp. D | Comp. E | Comp. F |
| Alumina-Zirconia Abrasive 12 & 14 mesh* | 57.60 | 57.60 | 57.60 | 57.60 |
| Phenol Formaldehyde resin | 21.89 | 21.89 | 21.89 | 21.89 |
| Powdered Cryolite $Na_3AlF_6$ | — | 6.145 | — | — |
| Polyvinylidene Chloride | 1.15 | 1.15 | 1.15 | 2.30 |
| Powdered Quick lime CaO | 3.07 | 3.07 | 3.07 | 3.07 |
| Sodium Chloride NaCl | — | — | 6.145 | — |
| Kyanite ($Al_2SiO_5$) −200 mesh | 12.29 | 6.145 | 6.145 | 11.14 |
| Chopped Fiberglass | 4.00 | 4.00 | 4.00 | 4.00 |

*Any mesh size is described herein is a U.S. Standard Sieve Size.

Wheels were made with Compositions C, D, E and F set forth above that were conventionally cured hot pressed wheels 16" in diameter, 1½" thick with 6" center holes. These wheels were compared with similar sized and cured wheels made with the composition B of Table I.

The wheels of the invention were compared with the standard silicon carbide, cryolite filled wheel B that has been found to be the most durable wheel used heretofore for the snag grinding of titanium. The tests were run on a laboratory Fox billet grinder for the snagging grinding of a commercially pure type 4 titanium under the following conditions:

TABLE III

| Test | Constant Power | Avg. Wheel Speed | Number of Runs | Total Contact Time |
|---|---|---|---|---|
| No. 1 | 25 KW | 9800 SFPM | 2 | 6 Min. |
| No. 2 | 35 KW | 9500 SFPM | 1 | 2 Min. |
| No. 3 | 35 KW | 11650 SFPM | 1 | 2 Min. |

The data recorded and grinding ratios determined during these test runs are set forth below in Table IV, Sections 1A, 1B and 1C.

TABLE IV

| Fox Test No. 1 | | Section 1A | | 25 KW. | |
|---|---|---|---|---|---|
| Speed (SFPM) | Variation | WWR ($in^3$/hr) | MRR (lbs/hr) | G Ratio | Power KW |
| 9673 | Bond B | | | | |
| 9499 | | (T = Avg of 2 runs) | | | |
| 9586 | | T 204.07 | 87.00 | 0.43 | 25.8 |
| 9907 | | | | | |
| 9692 | Bond C | | | | |
| 9800 | | T 258.93 | 89.00 | 0.34 | 25.9 |
| 9891 | | | | | |
| 9733 | Bond D | | | | |
| 9812 | | T 200.05 | 79.00 | 0.39 | 25.0 |
| 9879 | | | | | |
| 9676 | Bond E | | | | |
| 9778 | | T 250.06 | 92.50 | 0.37 | 26.0 |

TABLE IV-continued

| | | | | | |
|---|---|---|---|---|---|
| 9873 | | | | | |
| 9686 | Bond F | | | | |
| 9779 | | T 235.16 | 85.00 | 0.36 | 25.0 |
| Fox Test No. 2 | | Section 1B | | 35 KW. 4CP TIT | |
| Speed (SFPM) | Variation | WWR ($in^3$/hr) | MRR (lbs/hr) | G Ratio | Power KW |
| 9318 | Bond B | 350.37 | 124.50 | 0.36 | 35.1 |
| 9468 | Bond C | 428.92 | 132.00 | 0.31 | 35.1 |
| 9561 | Bond D | 333.42 | 132.00 | 0.40 | 35.4 |
| 9443 | Bond E | 441.95 | 136.50 | 0.31 | 36.0 |
| 9490 | Bond F | 401.32 | 142.50 | 0.36 | 35.7 |
| Fox Test No. 3 | | Section 1C | | 35 KW. High SP | |
| Speed (SFPM) | Variation | WWR ($in^3$/hr) | MRR (lbs/hr) | G Ratio | Power KW |
| 11437 | Bond B | 286.78 | 136.50 | 0.48 | 35.7 |
| 11597 | Bond C | 316.70 | 153.00 | 0.48 | 36.6 |
| 11753 | Bond D | 268.00 | 144.00 | 0.54 | 36.9 |
| 11570 | Bond E | 280.20 | 151.50 | 0.54 | 35.7 |
| 11640 | Bond F | 302.89 | 150.00 | 0.50 | 36.3 |

From these tests it is shown that during the runs with the lower power, the conventional silicon carbide filled wheel and the wheel of this invention including kyanite and cryolite are about equal as indicated by the comparative grinding ratios of the wheel with composition B versus the wheel with composition D. It is to be noted however that the use of low power does not represent the best snagging practice for grinding titanium which may account for the lower G ratios calculated for the other wheels in the test. When the power applied to the titanium grinding operation was increased, the G ratio of nearly all of the kyanite filled wheels improved and when the grinding wheel speed and the power were both increased, all of the invention wheels showed a better performance than the standard wheel against which they were tested. Note particularly the very substantial improvement in the G ratio of the D and E compositions at the higher speed and higher power. Taking into account the lower cost of kyanite as compared to silicon carbide even when the grinding results are equal, there is a significant cost saving in favor of the wheels made with a kyanite filler and when superior grinding performance can be added to this cost advantage, it is apparent that a substantial improvement in the snagging wheel grinding art has been made.

In another test, standard wheels with composition B as in Table I, were compared with wheels of this invention made with the composition D set forth in Table II. These tests were run on a 100 H.P. Beardsley & Piper Track Grinder at 12,500 S.F.P.M. wheel speed. All of the wheels were 24" in diameter, 3" thick with a 12" diameter hole in the center surrounded by a 15½" diameter fine grit section surrounding the hole. The results of this test are shown in Table V.

TABLE V

| Wheel and Bond | WWR ($in^3$/hr) | MRR (lbs/hr) | Contact (time/hr) | G ratio (lbs/$in^3$) | Power (HP) |
|---|---|---|---|---|---|
| (1) Standard Bond B | 855 | 322 | 0.95 | 0.38 | 85 |
| (2) Standard Bond B | 882 | 389 | 0.92 | 0.44 | 76 |
| Avg. Bond B Wheels | 868 | 355 | 0.93 | 0.41 | 81 |
| (3) Invention Bond D | 805 | 461 | 1.01 | 0.57 | 78 |
| Improvement with Invention | −7% | +30% | +9% | +39% | |

These data show the wheel with kyanite filler to have a 30% greater G ratio. Titanium is known to be a difficult metal to grind and therefore the discovery of a new filler for the wheels used for grinding this metal which provides the substantial improvement in the G ratio noted in the various tests of the kyanite filled wheels as compared with the standard silicon carbide filled wheels now used for grinding titanium, is an important step forward. That discovery is of special commercial significance because the kyanite filler is currently available at a price of about 18% of the price of the powdered silicon carbide filler now used in wheels for snagging titanium.

With respect to the manufacture of grinding wheels made with a kyanite filler, no changes need be made in the proceedure for mixing and pressing the wheels with the exception of the substitution of kyanite or its equivalent of sillimanite, andalusite, mullite or any similar alumino-silicate mineral for silicon carbide or other filler if such a filler is used instead of SiC. Either one of these equivalent fillers may be used in a range of from about 6% to 13% (or even higher) of the volume of the composition of the mix formulation from which the wheel is made. This filler is used in a mesh size of less than 35 mesh and preferably less than −200 mesh. Other conventional fillers may be used for their added beneficial effects without detriment to the serviceability of the kyanite, sillimate, andalusite, mullite or similar alumino-silicate filled wheels.

Another characteristic studied during the development of the wheels of this invention, was the effect of kyanite on the bond strength of the cured wheel. Three of the wheels made with the compositions B, C and D of Table II that were used in the tests, the results of which were tabulated in Table III, were subsequently cut into ½" by ½" bars. These bars were broken in an Instron Mechanical Tester in a three point bending set-up with a 2" span. Three flexural tests were performed per bar and the results were as follows:

TABLE VI

| Wheel Composition | Composition Variation* (Vol. %) | Flexural Strength No. of Flexural Tests | (psi) Avg. Flexural Strength | Std. Dev. | Diff. |
|---|---|---|---|---|---|
| B | SiC Filler 5.76<br>Cryolite 6.53 | 12 | 12178 | 856 | — |
| C | Kyanite 12.29 | 12 | 13579 | 445 | +12% |
| D | Kyanite 6.145<br>Cryolite 6.145 | 6 | 11848 | 365 | −3% |

*All compositions contained the same vol. % of abrasive, resin, quick lime, polyvinylidene chloride and chopped fiberglass.

The results indicate the powdered cryolite, Na3AlF6, tends to weaken the bond composition compared to powdered silicon carbide and kyanite. Invention Composition C with the highest amount of kyanite and no cryolite is the strongest and is statistically significantly stronger than the standard. Invention Composition D with an approximate substitute of kyanite for silicon carbide is not statistically different from the standard.

As noted, bond strength is an important attribute in grinding, especially for grinding titanium. Kyanite and cryolite have benefit as grinding aids compared to silicon carbide, and as shown, kyanite does not compromise bond strength.

All of the tests reported herein shown comparative grinding results using the wheels of this invention for heavy duty or snag grinding of titanium. The wheels described herein will also be found to have utility for the snag grinding of ferrous billets and steel alloys. The use of kyanite, sillimanite, and andalusite are suggested for use as a filler in hot pressed grinding wheels as a substitute for silicon carbide filler.

The above description is based on the best mode known to the inventors at the present time, and is not to be considered limiting. The product of this invention is a resin bonded grinding wheel especially useful for the grinding of titanium metal. It is possible that modifications thereof may occur to those skilled in the art that will fall within the scope of the following claims.

We claim:

1. A resin bonded grinding wheel containing an abrasive grain adapted for grinding metal, said wheel containing grinding aid means including a grinding aid which is a particulate alumino-silicate selected from the group consisting of sillimanite, mullite, kyanite, andalusite, and mixtures thereof.

2. A wheel as in claim 1 wherein the wheel is a hot pressed billet grinding wheel.

3. A wheel as in claim 2 wherein said grinding aid means also includes cryolite.

4. A wheel as in claim 3 wherein said grinding aid means also includes lime.

5. A wheel as in claim 1 wherein said grinding aid means also includes an alkali metal halide or mixtures thereof.

6. A wheel as in claim 2 wherein said wheel includes about 57% by volume of abrasive grits, about 22% by volume phenol formaldehyde resin bond, about 6.1% cryolite by volume, about 1.2% polyvinylidene chloride by volume, about 3.1% CaO by volume, about 6.1% kyanite by volume, and the remainder being chopped fiberglass filler.

7. A grinding wheel as in claim 2 wherein said wheel includes about 57% alumina-zirconia abrasive grits sized 12 to 14 mesh by volume, about 22% phenol formaldehyde resin by volume, about 1.2% polyvinylidene chloride by volume, about 3.1% CaO by volume, from 6.1% to 12.3% by volume of kyanite sized less than 200 mesh, and the remainder being chopped fiberglass filler.

8. A grinding wheel as in claim 7 wherein said grinding aid means includes powdered cryolite present in an amount of about 6.1% by volume.

9. A grinding wheel as in claim 7 wheein said grinding aid means includes sodium chloride present in an amount of about 6.1% by volume.

* * * * *